United States Patent [19]

Kuhlmann

[11] 4,368,598

[45] Jan. 18, 1983

[54] HAND-HELD POWER GRINDING TOOL

[75] Inventor: Gerhard Kuhlmann, Stuttgart, Fed. Rep. of Germany

[73] Assignee: Robert Bosch GmbH, Stuttgart, Fed. Rep. of Germany

[21] Appl. No.: 232,241

[22] Filed: Feb. 6, 1981

[30] Foreign Application Priority Data

Mar. 21, 1980 [DE] Fed. Rep. of Germany ..... 3010838

[51] Int. Cl.[3] ..... B24B 23/04; B24B 55/06

[52] U.S. Cl. ..... 51/170 R; 51/273

[58] Field of Search ..... 51/170 R, 170 T, 170 TL, 51/170 MT, 273

[56] References Cited

U.S. PATENT DOCUMENTS

| | | | |
|---|---|---|---|
| 1,749,705 | 3/1930 | Hudspith | 51/170 T |
| 2,786,313 | 3/1957 | Shaff | 51/170 MT |
| 3,375,616 | 4/1968 | Scott et al. | 51/170 TL |
| 3,619,954 | 11/1971 | Miller | 51/170 T |

FOREIGN PATENT DOCUMENTS

| | | | |
|---|---|---|---|
| 1652152 | 5/1970 | Fed. Rep. of Germany | 51/170 TL |
| 1938350 | 2/1971 | Fed. Rep. of Germany | 51/170 TL |
| 621967 | 3/1981 | Switzerland | 51/170 TL |

*Primary Examiner*—Roscoe V. Parker

*Attorney, Agent, or Firm*—Michael J. Striker

[57] ABSTRACT

A hand-held power tool, particularly a grinding machine and the like, has a housing, a working platen movable between an inoperative position, and an operative position in which it oscillates relative to the housing, movable conduits for transporting a material removed by the working platen, and control elements for operating the power tool, wherein the control elements are located within a region which extend normal to a surface which is overlapped by the platen so that only the movable conduits extend outwardly beyond this region. The power tool is provided with a handle which is pivotable about an imaginary extension of the axis of the working platen.

16 Claims, 4 Drawing Figures

HAND-HELD POWER GRINDING TOOL

BACKGROUND OF THE INVENTION

The present invention relates to a grinder (dresser) which is formed as a hand-held power tool.

Grinders of the above-mentioned general type are known in the art. One of such grinders is disclosed, for example, in the U.S. Pat. No. 3,375,616. This grinder, as well as other known grinders, has a working platen which oscillates relative to a housing, and a handle which usually extends in direction of the longitudinal axis of the platen. The handle is provided with a preferably arrestable pressure switch, which makes possible to actuate and simultaneously to displace the device by a hand gripping the handle. Because of the possibility to arrest the switch, the handle can be released and the power tool can be retained at locations which are favorable for the operation. For supporting the hand which displaces the machine, a second hand serves for the eventually necessary embrace, the pressing against the working surface, or the holding of the suction conduit of a dust aspirating arrangement. The handle, as well as other control elements which are fixedly connected with the housing of the power tool, and the pipes of the suction conduits extend in different directions above the working surface of the working platen outwardly of the same. This results in limiting of the working area of the power tool. At the sides when such structural elements extend outwardly beyond the working surface of the platen, the working surface of the platen cannot approach a wall of the like so as to grind or dress the entire required surface. These operational difficulties are aggravated by the fact that the known grinder must be held and guided in different directions by the holding hand, inasmuch as the tool handle does not provide any operational control during surface working. The holding hand must always provide for a working pressure normal to the working surface of the grinding platen and also reciprocate the entire power tool in direction lengthwise of and transverse to the lower arm axis. The position of the working surface of the grinding platen can be from horizontal to vertical, from floors to overhead locations. When the control is performed by the movable handle, the position of hand is not always advantageous for possibly long lasting operation. When the hand joint which is in a movement-end position, the vibrations of the power tool act upon the anatomic contact faces in the hand joint in bearing manner and thereby are health hazardous for the operators.

SUMMARY OF THE INVENTION

Accordingly, it is an object of the present invention to provide a hand-held power tool, particularly a grinding machine and the like, which avoids the disadvantages of the prior art.

More particularly, it is an object of the present invention to provide a hand-held power tool of the above-mentioned type, which is characterized by the fact that the operational space of it is not limited in any direction, so that the grinding machine can unobjectionably be displaced in all directions to edges, walls and the like near the working surface of the grinding platen.

In keeping with these objects and with others which will become apparent hereinafter, one feature of the present invention resides, briefly stated, in a hand-held power tool, particularly a grinding machine, in which all parts of the machine are confined within a region which extends normal to a surface overlapped by a working platen of the machine. No parts extend outwardly beyond this region, with the exception of movable conduit means operative for transporting a removed material.

In accordance with another especially advantageous feature of the present invention, the grinding machine has a handle whose gripping part is parallel to the grinding platen and is pivotable about an imaginary extension of an axis of the grinding platen. This makes possible lower arm movements in a wide range during guidance of the grinding machine, during which the normal position of the hand must not be changed.

Still another feature of the present invention is that the handle is provided with spring means which urges the handle away from the housing and at the same time provides for a vibration-unloading connection between the handle and the housing of the machine.

In accordance with a further feature of the present invention an adaptor is fixedly connected with the housing and the handle is provided with a ring which is fixedly connected with the handle and pivots together with the latter around the adaptor.

A further feature of the present invention is that a switch is arranged in the region of an axial displacement of the handle toward the housing so that when the grinding machine is pressed against a surface to be worked, the handle presses against the switch and actuates the machine, and when the grinding machine is lifted from the surface to be worked the handle displaces and deactivates the switch so that the machine is switched off.

Finally, one more feature of the present invention is that the pipe of an aspirating arrangement can be connected with a suction conduit by a swivel joint or a spherical joint, and the end portion of the pipe may form one part of each of these joints.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
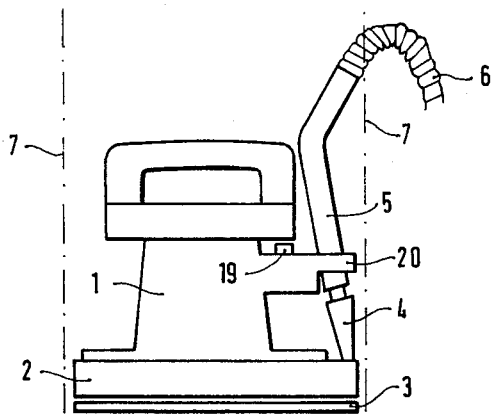
FIG. 1 is a view showing a grinding or pressing machine designed as a hand-held tool.

A grinding or dressing machine which is formed as a hand-held power tool has a housing which is identified by reference numeral 1, a suction frame 2, and a grinding platen 3 connected with each other in a known manner. A pipe 4 extends from the upper region of the suction frame 2 and is connected with a dust aspirating arrangement by a suction conduit 5. The free end of the suction conduit 5 is connected with a flexible exhaust conduit 6 which is known in the art.

A handle is arranged on a head of the housing 1. The handle is shown in detail in FIG. 2. As can be seen from FIG. 1 all immovable parts on the housing 1 do not extend outwardly beyond the region which is identified by dotted lines. This region extends normal to the grinding platen 3 or the surface which is overlapped by the oscillating grinding platen when the machine does not operate. This advancement corresponds to the not shown lateral view of FIG. 1.

Figure 2:
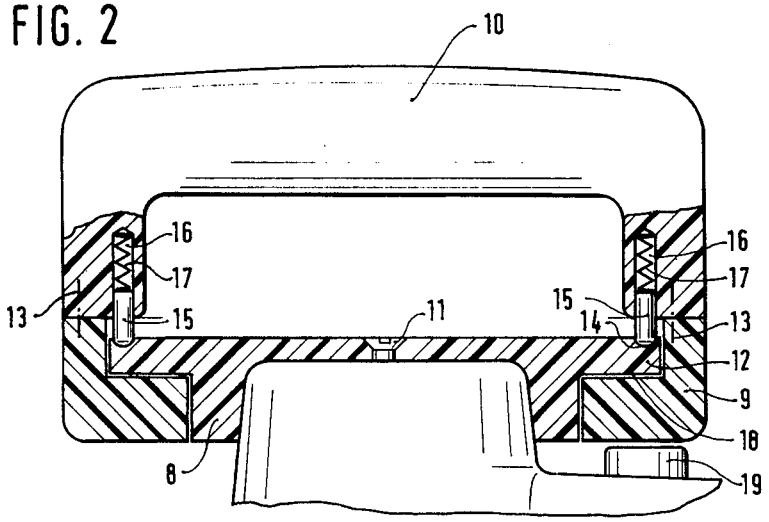
FIG. 2 is a view showing a handle of the grinding machine of FIG. 1.

The handle illustrated in FIG. 2 has an adaptor 8, a guiding ring 9 and a gripping member 10. The adaptor 8 is fitted on the head of the housing 1 in interengaging (form-locking) manner and connected with the same by a screw 11. The adaptor 8 has a marginal portion 12 which is surrounded by the guiding ring 9. The guiding ring 9, in turn, is fixedly connected with the gripping member 10 by screws identified by dash-dot lines 13.

As can be seen from FIG. 2 the upper face of the adaptor 8 has arresting depressions 14 in which arresting pins 15 engage. The arresting pins 15 are guided in openings 16 provided in the gripping member 10. Helical springs 17 are arranged in the openings 16 and urge the arresting pins 15 toward the adaptor 8. Under the action of the springs 17, the guiding ring 9 connected with the gripping member 10 is pulled to the abutment against a ring-shaped end face 18 of the adaptor 8. The ring-shaped end face 15 is opposite to the end face provided with the depressions 14.

As can also be seen from FIG. 2, an actuating member 19 of an on-off switch for the grinding machine is arranged below the end face of the guiding ring 9. The actuating member 19 is so located that when the grinding machine is pressed by the gripping member 10 against the surface to be worked, the guiding ring 9 acts upon the actuating member 19 in switching on direction. When the working pressure on the gripping member 10 is removed, the ring 9 moves under the action of the springs 17 in the opposite direction and the actuating member 10 moves in switching off direction.

The gripping member 10 is of a type which is utilized in a shovels. It is bridge-shaped or U-shaped. During the displacement toward and away from the actuating member 19, the gripping member 10 is guided by the arresting pins 15. The springs 17 not only urge the guiding ring 9 of the handle into abutment against the adaptor 8, but also connect the gripping member 10 with the housing in such a manner that the vibrations to which the housing is subjected during the operation are not transmitted or are transmitted to only an insignificant extent to the gripping member 10.

Figure 3:
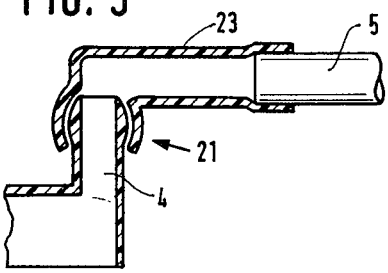
FIG. 3 is a view showing the ball joint connecting a pipe with a suction conduit of an aspirating arrangement of the grinding machine in accordance with the invention.

As shown in FIG. 1, the pipe 4 is connected with a suction conduit 5 with the aid of an additional holding ring 20. A somewhat different construction is shown in FIG. 3. Here, the free end of the pipe 4 forms a part of a spherical joint identified by references numeral 21. The joint 21 serves for connection of the pipe 4 whith the suction conduit 5. More particularly, an adaptor 23 is provided which is directly connected with the suction conduit 5, and has an end portion which forms the other part of the spherical joint 21, the other part connected with the above-mentioned one part formed by the end portion of the pipe 4.

Figure 4:
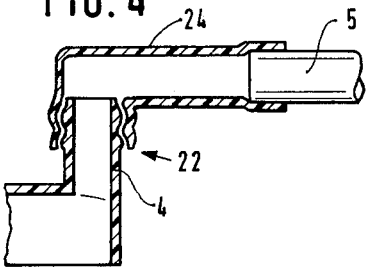
FIG. 4 is a view showing a swivel joint which connects the pipe with the suction conduit of the aspirating arrangement.

FIG. 4 shows that the pipe 4 may be connected with the suction conduit 5 by a swivel joint. The pipe 4 has an end portion formed as one part of the swivel joint which is identified by reference numeral 22. An adaptor 24 connected with the suction conduit 5 is also provided. The adaptor 24 has an end portion which forms the other part of the swivel joint, the other part connected with the above-mentioned one part of the swivel joint 22. In all constructions it is guaranteed that all movable supply and withdrawal conduits extend outwardly beyond the grinding machine working space which is normal to the surface overlapped by the grinding platen.

When the grinding machine is designed in accordance with the present invention, the gripping portion 10 of the handle can be placed in a favorable position corresponding to the desired working condition of the machine and fixed in this position by the arresting pins 15. Then, the user applies pressure to the gripping portion 10 in condition when the grinding platen 3 abuts against a surface to be worked, until the actuating member 10 switches on the drive means of the grinding machine. Now the machine can perform working movements with optimal work of the operator. The springs 17 of the arresting pins 15 serve for unloading the gripping portion 10 from vibrations of the housing 1 during the operation of the machine. This also results in unloading of the operator. The central arrangement of the gripping portion 10 makes possible the stabilization of the working surface of the grinding platen, so that the operator encounters no difficulties in displacing the grinding machine over the surface to be worked in tilt-free manner. When the grinding machine is lifted from the surface to be worked, the drive is switched off. Thereby, no additional and expensive switch arresting means and operations are needed in the hand-held machine. In addition to the cost economy, it is easy for the operator to work with the machine. The vibration unloading of the gripping portion 10 in condition of the prevailing unfavorable relation between the diameter of the guiding surface of the handle and its length, is surprisingly effective.

The fact that the removal of working pressure immediately interrupts the operation of the grinding machine makes considerably easier the work of the operator and eliminates unnecessary idling with the respective idling noise. This also contributes to energy economy and environmental unloading.

It will be understood that each of the elements described above, or two or more together, may also find a useful application in other types of constructions differing from the types described above.

While the invention has been illustrated and described as embodied in a hand-held power tool, such as a grinding machine and the like, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hand-held power tool, particularly a grinding machine and the like, comprising a housing; a working platen having an axis and arranged to move from an inoperative position to an operative position in which it oscillates relative to said housing, said working platen in said inoperative position overlapping a predetermined surface, said axis extending normal to said surface overlapped by said platen and having an imaginary extension; movable conduit means for transporting a material removed by said working platen; and control means for operating the power tool, said control means being located within a region which extends normal to said surface overlapped by said platen, so that only said movable conduit means extends outwardly beyond said region, said control means having a handle with an elongated gripping portion which extends substantially parallel to said working platen and is pivotable about said imaginary extension of said axis so as to assume a plurality of different radial positions relative to said housing.

2. A power tool as defined in claim 1, wherein said pivotable handle is formed as a shovel-type handle.

3. A power tool as defined in claim 2, wherein said pivotable handle is U-shaped.

4. A power tool as defined in claim 1; and further comprising means for arresting said pivotable handle in each of said different radial positions relative to said housing.

5. A power tool as defined in claim 1; and further comprising means connecting said pivotable handle with said housing, said connecting means including spring means urging said pivotable handle away from said housing and unloading said handle from vibrations to which said housing is subjected during the operation of the power tool.

6. A power tool as defined in claim 4; and further comprising spring means arranged to connect said pivotable handle with said housing so that said handle is unloaded from vibrations to which said housing is subjected during the operation of the power tool, said spring means also forming a part of said arresting means and arranged to maintain said pivotable handle in a respective one of said different radial positions.

7. A power tool as defined in claim 1; and further comprising an adapter which is fixedly connected with said housing, said handle being pivotable relative to said adapter.

8. A power tool as defined in claim 7, wherein said adapter is ring-shaped and outwardly surrounds said housing.

9. A power tool as defined in claim 7, wherein said adapter has a circular marginal portion; and further comprising a guiding ring which is fixedly connected with said handle and surrounds said marginal portion of said adapter, so as to pivot about the same together with said handle.

10. A power tool as defined in claim 1, wherein said pivotable handle and said housing are displaceable relative to one another in an axial direction over a predetermined region; and further comprising an off-switch for switching on and switching off of the power tool, said switch being arranged in said region so that when said working platen is pressed against a workpiece and said handle and said housing displaces toward one another the power tool is switched on, and when said working platen is lifted from the workpiece and said handle and said housing displace away from one another the machine is switched off.

11. A power tool as defined in claim 10; and further comprising an adapter fixedly connected with said housing and having a circular marginal portion, and a guiding ring fixedly connected with said handle and surrounding said marginal portion of said adapter so as to pivot about the same together with said handle, said guiding ring being arranged so as to act upon said switch during said displacement of said handle and said housing relative to one another.

12. A power tool as defined in claim 1, wherein said conduit means includes a pipe and a suction conduit connected with said pipe, said suction conduit extending radially outwardly beyond said region which is normal to said surface overlapped by said working platen.

13. A power tool as defined in claim 12; and further comprising holding means for holding said pipe of said conduit means, said holding means being located within said region which is normal to said surface overlapped by said working platen.

14. A power tool as defined in claim 12; and further comprising a swivel joint which connects said pipe with said suction conduit, said pipe having an end portion forming a part of said swivel joint.

15. A power tool as defined in claim 12; and further comprising a spherical joint which connects said pipe with said suction conduit, said pipe having an end portion forming a part of said spherical joint.

16. A power tool as defined in claim 12; and further comprising an adapter member connecting said pipe with said suction conduit.

* * * * *